United States Patent [19]

Douglas

[11] 3,995,582

[45] Dec. 7, 1976

[54] MOIST TISSUE DISPENSING

[75] Inventor: Livingston C. Douglas, Leonia, N.J.

[73] Assignee: Colgate-Palmolive Company, New York, N.Y.

[22] Filed: Dec. 19, 1974

[21] Appl. No.: 534,472

[52] U.S. Cl. ..... 118/43; 221/135; 206/205; 206/409; 242/68.7; 118/419

[51] Int. Cl.[2] ..... B05C 11/02

[58] Field of Search ..... 221/135; 206/812, 820, 206/403, 408, 409, 389, 225, 411, 205; 118/43, 419; 242/55.53, 68.7

[56] References Cited

UNITED STATES PATENTS

| | | | |
|---|---|---|---|
| 2,684,716 | 7/1954 | Mills et al. | 206/409 X |
| 3,310,353 | 3/1967 | Cordis | 118/43 X |
| 3,592,161 | 7/1971 | Hoffmann | 118/43 X |
| 3,743,205 | 7/1973 | Misrach | 242/68.7 |

*Primary Examiner*—Robert B. Reeves
*Assistant Examiner*—Joseph J. Rolla
*Attorney, Agent, or Firm*—Strauch, Nolan, Neale, Nies & Kurz

[57] ABSTRACT

A dispensing package comprises a toroidal container body enclosing a coreless rolled web of moisture absorbent material having free rotation about the axis of the body on body side wall areas of reduced diameter at opposite ends of a liquid reservoir, the leading end of the web being drawn through a longitudinal slot in a body side wall extending the full width of said web and through upper and lower flange lips defining with the slot a dispensing passage.

4 Claims, 6 Drawing Figures

FIG. 3
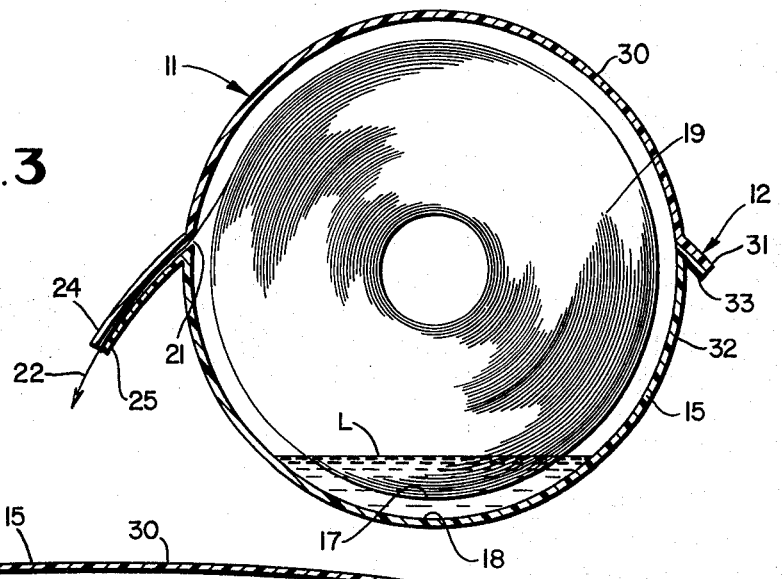
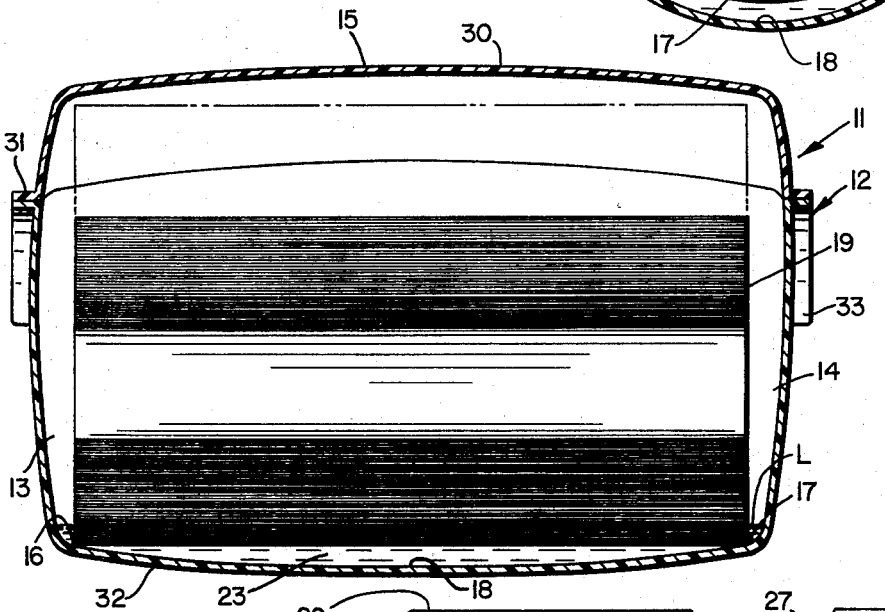
FIG. 4
FIG. 5
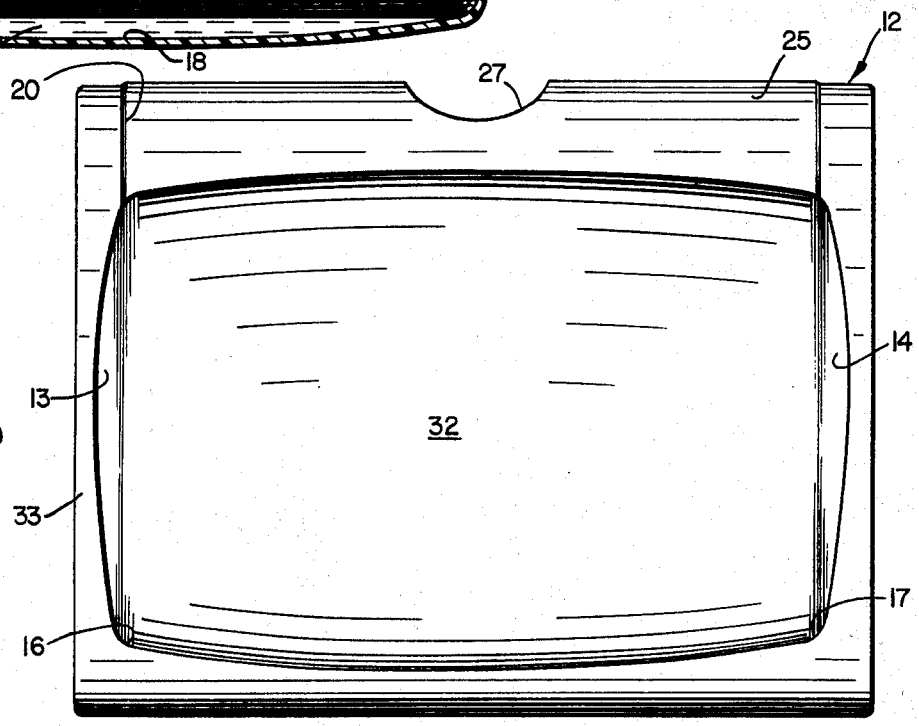

MOIST TISSUE DISPENSING

This invention refers to the dispensing of moist tissues from containers and particularly to special container construction and assembly.

The sealed packaging of individual folded moist towelettes as disclosed in Williams U.S. Pat. No. 3,057,467 is well known. These towelettes when extracted from the envelope and unfolded are usually about four by eight inches. Recently there has been a demand for larger moist towelettes or tissues and the present invention is directed to that field.

As will appear the invention more specifically relates to the dispensing of successive premoistened sheets of absorbent fibrous material such as paper tissue one at a time from a supply roll so packaged in a container as to prevent evaporation of the moisture agent during shelf life and prior to being sold to a consumer and to limit evaporation as much as reasonably possible during use by the consumer.

PRIOR ART AND THE INVENTION

In addition to the individual towelette envelopes, there is currently available on the market a moist towelette dispenser wherein premoistened towelettes comprising successive sheet sections of a continuous web wound in a roll stored in a container are extracted from the center of the roll and passed through a normally closed tight slit arrangement in the removable container cover. Perforated transverse lines separate the successive sheets. The leading sheet is drawn through the slit and a snap action is required to separate the leading sheet along its transverse perforations from the remainder of the web within the container and this must take place in such time as to locate the adjacent end of the next successive sheet at least partly projecting through the slit to be available for manual removal. Such a dispenser is disclosed in U.S. Pat. No. 3,749,296 issued July 31, 1973.

Walker U.S. Pat. No. 3,775,801 discloses a dispenser for moist sheet material wherein a roll of moistened sheet material is mounted on a core rotatable and slidable vertically in fixed guides within a container having a side wall opening through which material from the outer periphery of the roll is drawn, a knife edge being provided at the opening to sever desired lengths of dispensed material.

The successive dispensing of sheets from an interleaved supply of premoistened tissues has also been proposed as in Bilezerian U.S. Pat. No. 3,325,003 where the supply of moisture impregnated sheets is wrapped in a flexible moisture proof envelope that is opened by the ultimate consumer. Cordis U.S. Pat. No. 3,310,353 also discloses the dispensing of premoistened paper sheets.

The present invention involves improvements over the foregoing in that an improved assembly and container structure are provided wherein a free coreless roll of moistened paper or like absorbent material has minimum area support within the container for reduced resistance to unrolling, the leading end of the web is drawn full width from the outer periphery of the roll and through a narrow side slot and associated novel dispensing mouth structure, the container is advantageously shaped to provide a liquid reservoir space in optimum location relative to the outer layers of web on the roll, and the package consisting of the web roll, moistening liquid and container is a novel assembly. Other advantageous features will appear as the description proceeds.

BRIEF DESCRIPTION OF DRAWINGS

FIG. 3 is a section substantially on line 3—3 of FIG. 1;

FIG. 4 is a section substantially on FIG. 4—4 of FIG. 1;

FIG. 5 is a bottom plan view of the lower part of the container before assembly.

PREFERRED EMBODIMENTS

Figure 1:
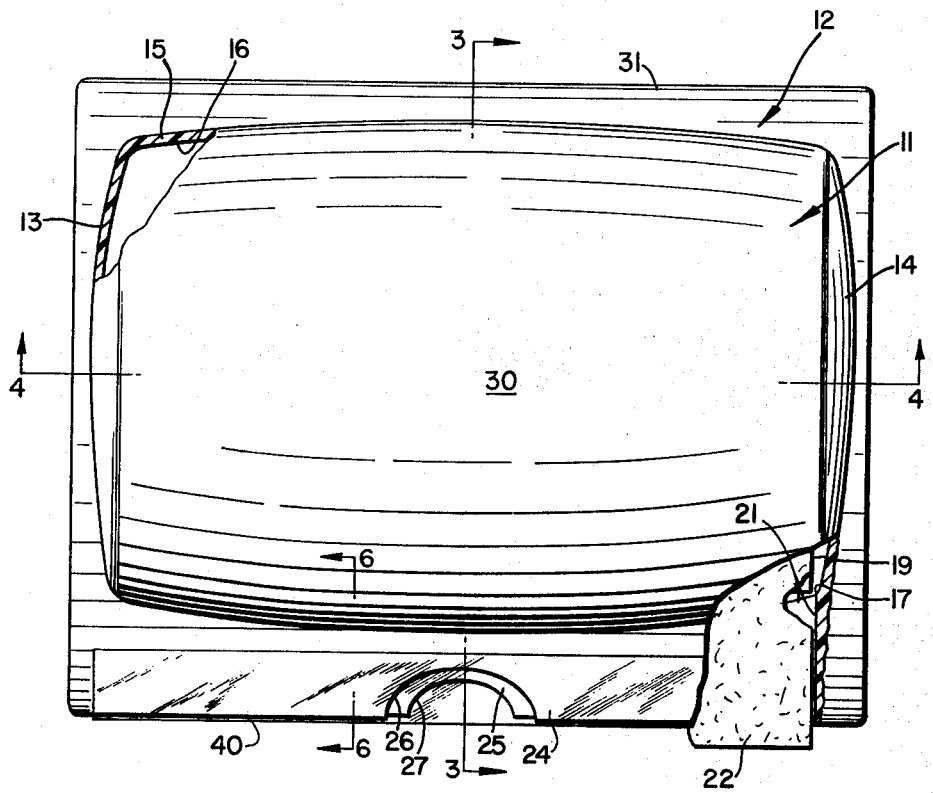
FIG. 1 is a top plan view showing a dispensing device according to a preferred embodiment of the invention.

The dispensing container comprises a generally barrel shaped molded plastic toroidal body 11 having affixed thereto a surrounding external flange 12. Body 11 has cup shaped opposite end walls 13 and 14 of the same diameter, and an annular side wall 15 which is symmetrical about a central longitudinal axis has similar gently sloping annular end areas 16 and 17 that approach the diameter of the end walls and are of materially greater diameter than the central area indicated at 18.

The length of side wall 15 is greater than the length of coreless cylindrical roll 19 of paper or like absorbent material that is to be housed in body 11 and dispensed therefrom. Side wall 15 is provided with a longitudinal slot 21 of a length slightly greater than the width of the web 22 that is wound to form roll 19, so that web 22 may be dispensed full width through slot 21.

FIG. 4 shows the location and support of otherwise free roll 19 within the container body. The opposite peripheral end areas of the coreless roll rest on the internal annular body surfaces 16 and 17, and the roll thereby bridges an annular bottom space indicated at 23, which space contains a reservoir of liquid that maintains the web moist. In practice the initial level of liquid in the container may be about at the level indicated at L in FIG. 4 whereby the outer web layers on the roll from which dispensing is first made through slot 21 will be kept moistened.

As shown in FIG. 4, as the diameter of roll 19 lessens during dispensing the roll merely lowers within the container maintaining the same supporting engagement with areas 16 and 17. Since the web 22 is dispensed from the outer periphery of roll 19 maximum torque is exerted during dispensing and this circumstance coupled with the small areas of contact between the rotating roll and the wet smooth plastic body surfaces that minimize friction provides for efficient easy and trouble-free dispensing. No guides are needed within the container and less expensive coreless rolls of absorbent paper may be used.

As shown in FIG. 3 the leading end of web 22 after passing through slot 21 extends through a dispensing and guiding mouth defined by parallel lips 24 and 25 which extend the length of the slot and are substantially tangential to the initial roll diameter so that a substantially straight line pull is exerted on the roll during dispensing. As shown in FIG. 1 the central portions of the lips are edge notched at 26 and 27 to enable the user to grip the web to start each dispensing operation.

Figure 2:
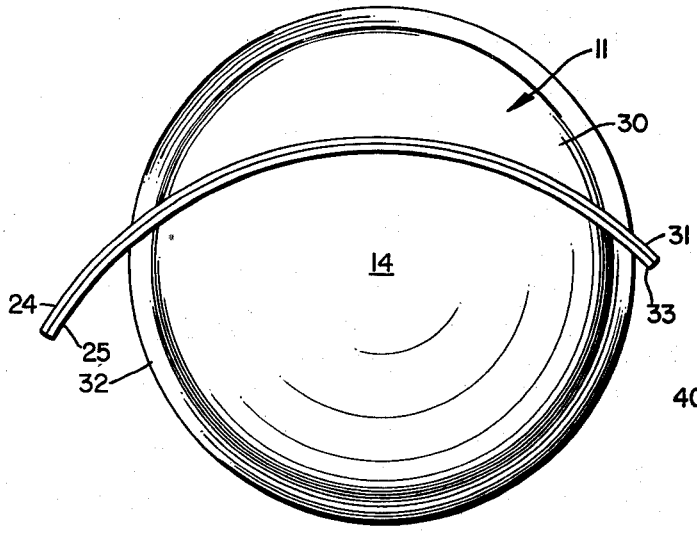
FIG. 2 is an end view of the device of FIG. 1.
Figure 6:
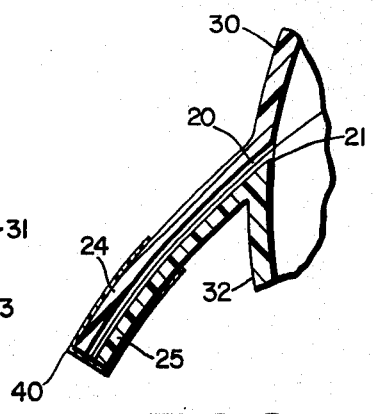
FIG. 6 is an enlarged fragmentary view in section showing the dispensing mouth.

The flange 12 preferably extends longitudinally around the body 11 as shown and may be slightly arcuate transversely as viewed in FIG. 2. The lips 24 and 25 are formed as parts of flange 12 along slot 21 and may be integral with body 11. The entire device may be a substantially integral plastic unit in final assembly, and this may be accomplished by molding the upper part having a first body section 30 formed with a rim 31 and a lower part having second body section 32 formed with a corresponding rim 33 and securing them in assembly. In such assembly the treatment or other liquid may be placed in the lower body section where it collects in space 23, then the coreless roll 19 is placed in the lower body section with the leading end of web pulled out to extend over lip 25 which (see FIG. 5) is depressed at this point for the length of slot 21 to effectively form a dispensing passage 20 the inner end of which is slot 21. The leading edge of web 22 will extend over notch 27.

Now the upper part is placed over the lower part, rims 31 and 33 being of the same shape and size for full surface engagement all around except for the dispensing passage 20 between lip 25 and the corresponding part of rim 33 that extends to provide lip 24. The rims 31 and 33 are now adhesively or heat sealed together all around the flange to form a unitary package.

In practice a length of pressure sensitive tape indicated at 40 may be initially bridged over the notches 26, 27 and extending the length of lips 24, 25 so that the package is completely sealed up until the time the consumer dispenses the first sheet. The effective distance between lips 24 and 25 is just enough to permit tightly sliding passage of web 22 without squeezing the liquid therefrom, and this in effect prevents drying out of the web except possibly a fringe edge at the front open end of the passage even though some time may elapse between dispensing operations.

Flange 12 also provides an effective handle that may be grasped by the consumer to steady the device as he is pulling out the leading end of the web.

The web 22 in a preferred embodiment is continuous and consists of a non-woven fabric that can readily absorb the particular liquid to be applied. It can be separated into individual sheets by score lines, or it may be severed in random lengths as by a knife edge provided along the outer edge of one of lips 24 or 25.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A dispensing package for the supply of moist sheet material comprising a container body having a longitudinal axis and enclosing a web of moisture absorbent material wound in a coreless cylindrical roll that is disposed within the body for free rotation about an axis generally parallel to said body axis, said body being closed except for a longitudinal slot in a side wall extending at least the full width of said web, flange means providing upper and lower lips extending outwardly from said slot and defining with said slot a dispensing passage through which the leading end of said web is drawn from the outer periphery of said roll during dispensing, and side wall means within said body below said longitudinal axis providing two similar spaced narrow internal surface areas of bearing support for the opposite ends of said roll and a liquid reservoir space below said roll located longitudinally between said areas, said areas being oppositely inclined to diverge toward the adjacent ends of said body and providing the sole support of said roll within the body, and said space containing liquid at a sufficient level to contact the lower sector of the supported roll.

2. A dispensing package as defined in claim 1, wherein said body is generally toroidal and symmetrical about said axis and said roll supporting areas are annular and inclined toward respective body end walls.

3. A dispensing package as defined in claim 1, wherein at least one of said lips has an edge notch for grasping the leading edge of said web for dispensing.

4. A dispensing package as defined in claim 1, wherein said body comprises cooperating upper and lower parts of molded synthetic plastic secured together at said flange means, with at least one of said flange means being recessed to form said dispensing passage.

* * * * *